United States Patent [19]

Occhipinti

[11] 4,128,289

[45] Dec. 5, 1978

[54] ELECTRICAL CONNECTOR HAVING A LOW INSERTION FORCE FOR FLAT CIRCUIT BEARING ELEMENTS

[75] Inventor: Carl Occhipinti, Melrose Park, Ill.

[73] Assignee: Bunker Ramo Corporation, Oak Brook, Ill.

[21] Appl. No.: 580,457

[22] Filed: May 23, 1975

Related U.S. Application Data

[63] Continuation-in-part of Ser. No. 415,147, Nov. 12, 1972, abandoned.

[51] Int. Cl.[2] ..... H01R 13/54

[52] U.S. Cl. ..... 339/75 MP; 339/176 MP

[58] Field of Search ..... 339/17, 75, 176

[56] References Cited

U.S. PATENT DOCUMENTS

| | | | |
|---|---|---|---|
| 3,317,879 | 5/1967 | Smith | 339/75 MP |
| 3,550,062 | 12/1970 | Drenten et al. | 339/75 MP |
| 3,772,634 | 11/1973 | Hennessey et al. | 339/75 MP |
| 3,789,345 | 1/1974 | Reimer et al. | 339/75 MP |
| 3,795,888 | 3/1974 | Nardo et al. | 339/176 MP |

FOREIGN PATENT DOCUMENTS

| | | | |
|---|---|---|---|
| 866052 | 4/1961 | United Kingdom | 339/75 MP |

OTHER PUBLICATIONS

IBM Bulletin, Ecker et al., Latch, 4–1968, vol. 10, No. 11, p. 1652.

*Primary Examiner*—Joseph H. McGlynn
*Attorney, Agent, or Firm*—William Lohff; F. M. Arbuckle

[57] ABSTRACT

An electrical connector for a flat circuit-bearing element, such as a calculator display element, is constructed to hold the element at an angle with respect to a supporting surface. The element is initially inserted into the connector at an angle and rotated into a mating position so that insertion force is low and contact force is high in the mating position. In one embodiment the connector is constructed to hold the element at a fixed angle with respect to a supporting surface, while in another embodiment the connector includes a rotatable element holding member which permits selective angular disposition of the element within certain limits of angular position of the rotatable member. Each embodiment includes camming ramps directed toward an element retaining recess for positive location of the element in the mating position. A retaining member movably or pivotally secured on the arms of the holding member is pivoted to permit insertion of the element between the arms and is then pivoted back to retain the element between the arms.

5 Claims, 4 Drawing Figures

ELECTRICAL CONNECTOR HAVING A LOW INSERTION FORCE FOR FLAT CIRCUIT BEARING ELEMENTS

BACKGROUND OF THE INVENTION

RELATED APPLICATION

This is a continuation-in-part of application Ser. No. 415,147, filed Nov. 12, 1973, now abandoned.

FIELD OF THE INVENTION

This invention relates to electrical connectors, and more particularly to electrical connectors for flat circuit-bearing elements having a low insertion force and positive element location.

DESCRIPTION OF THE PRIOR ART

It is well known in the art to connect flat-circuit bearing elements, such as printed circuit boards, to other electrical circuits by way of an electrical connector. The electrical connector generally functions as a socket and the flat element acts as a plug received by the socket. Ordinarily, the element has conductive pads aligned along one edge of one or both sides thereof which are contacted by metallic spring contacts within the electrical connector. In order to obtain good electrical contact, the contacts are disposed in an interference relationship with respect to the path of insertion of the circuit element so that they are biased into engagement with the respective conductive pads as the element is inserted into the connector.

Inasmuch as a great number of contacts may be required in an electrical connector, and inasmuch as the contact force operates on the element both during insertion and removal, the force required to insert and remove an element may become quite high. In order to overcome the drawbacks of insertion force, and still maintain good electrical contact between the connector contacts and the conductive pads of a circuit board, various improvements have been made in connectors to control the insertion force. For example, U.S. Pat. Nos. 3,611,259 and 3,697,929 both assigned to The Bunker Ramo Corporation, disclose the utilization of cams for moving the contacts out of the insertion path of a circuit board; the cam then being operated to permit engagement between the contacts and the respective conductive pads of the circuit board, after insertion.

Ordinarily, an electrical connector for a printed circuit board or the like mounts the circuit board perpendicular to a supporting surface and it is not unusual to have a series of parallel connectors, or a single multiple connector, mounting a plurality of circuit boards parallel to each other and perpendicular to a supporting surface. It is, however, sometimes highly desirable to mount a circuit bearing element at some angle other than 90° with respect to a supporting surface. For example, in small calculators, particularly the small electronic desk and hand-held calculators, it is desirable to mount a numerical display element at an angle which is easily viewed by an operator. It is possible, of course, to adapt standard connectors for this purpose through the utilization of specially designed mounting brackets; however, this requires additional parts and additional assembly time. Also, if a connector is to be adaptable to a variety of angles, rather than a fixed angle, a like variety of mounting hardware is necessary which would compound the aforementioned drawback.

Electrical apparatus, such as auxiliary appliance devices and electrical connectors, for directing electrical wiring have been developed and placed into use. These devices utilize conductive rings, brush contacts, wiping tabs and fork contacts for continuing an electrical circuit or circuits at an angle.

SUMMARY OF THE INVENTION

It is a primary object of the present invention to provide an electrical connector which will accept a flat circuit-bearing element with a low insertion force, yet provide a sufficiently high contact force to ensure proper electrical continuity.

Another object of the invention is to provide an electrical connector which will receive and retain a circuit-bearing element at an angular disposition with respect to a supporting surface.

Another object of the invention is to provide an electrical connector which is adaptable to receive and retain a circuit-bearing element at a variety of desired positions within certain angular limits with respect to a supporting surface.

The above objects are realized in two basic constructions, one of which provides a fixed angular disposition of the circuit-bearing element while the other includes a base with a rotatable element retaining member for assuming different angular dispositions.

In each of the basic constructions, an elongate slot is provided with sidewalls formed to initially receive the circuit-bearing element at an angle with respect to a final mating position, and to guide the element into the mating position. During initial insertion, the spaced relation of the slot sidewalls and the electrical contacts of the connector is such so as to present a low insertion force for the element. After initial insertion, the element is rotated against the contacts and into the final mating position wherein a sufficiently high contact force is provided to ensure good electrical continuity. Advantageously, contact wiping is provided during rotation.

One of the sidewalls of the slot includes a ramp-type cam for engaging and guiding the circuit-bearing element toward a recess which defines the aforementioned mating position. The recess may take the form of a pair of spaced outwardly extending arms each having a stepped edge construction facing the other such arm for receiving corresponding edges of the circuit-bearing element. The element may be retained in the recess by a variety of mechanisms including a cover having an interference, friction, or other suitable fastening relation to the arms, and having a slot or groove for receiving a corresponding edge of the circuit-bearing element. One form of retainer means is the use of a retaining member or cover pivotally mounted or movably secured on the arm and pivotable in one direction to one position to enable insertion of the element and pivotable in the opposite direction to a second position to hold the contacts or pads of the element in engagement with the contacts of the connector and form a window frame for enabling facile visual inspection of the circuit element.

The arms may be formed as a one-piece construction with a base and extend at a fixed angle with respect to a mounting surface of the base. Alternatively, the element holder and retainer member may be pivotally or rotatably mounted to the base to obtain a more flexible and adaptable connector for use in different equipment wherein the angle of disposition of the element with respect to a supporting surface may be varied, at least within certain angular limits.

BRIEF DESCRIPTION OF THE DRAWINGS

The above and other objects, features and advantages of the invention will be best understood from the following detailed description taken in conjunction with the accompanying drawings, on which.

DESCRIPTION OF THE PREFERRED EMBODIMENTS

Figure 1:
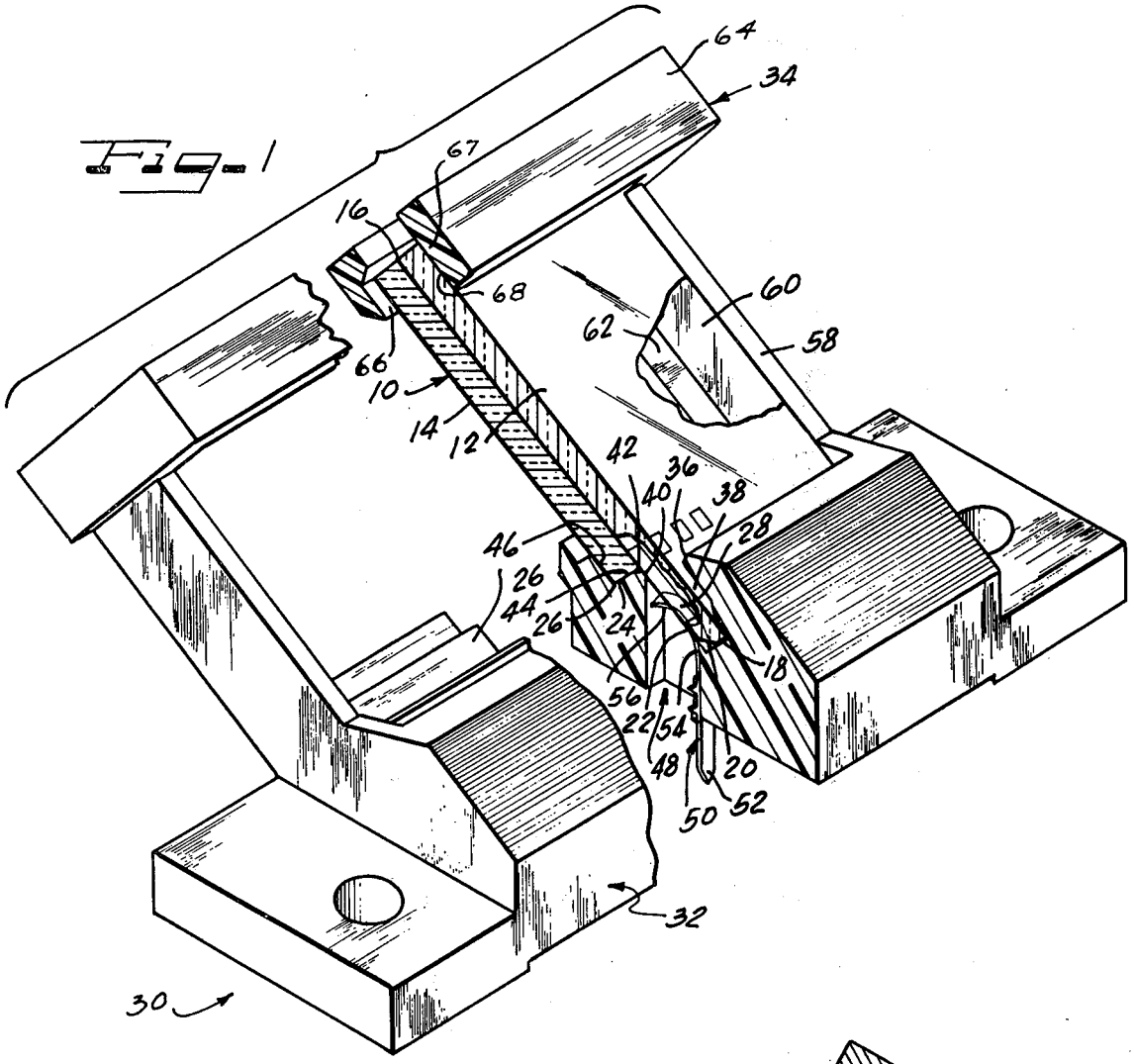
FIG. 1 is a pictorial representation, shown partially in section, of an electrical connector constructed in accordance with the present invention, particularly illustrating a fixed angle of disposition of a circuit-bearing element with respect to a supporting surface, as generally seen from the front.

Referring first to FIG. 1, a flat circuit-bearing element 10 is to be received and retained at an angular position with respect to a mounting surface. The element 10 may be, for example, a ceramic-type indicator employed for a data display in an electronic calculator. As seen in FIG. 1, the element 10 comprises a front surface 12, a rear surface 14, an upper edge 16, and a stepped lower construction including a lower edge surface 18, a ramp surface 20, a second rear surface 22 and a second lower edge surface 24. The rear surface 22 carries a plurality of conductive strips or pads for connection to external conductive elements.

An electrical connector, in the form of a receptacle, generally referenced 30, is provided to hold the element 10 at a fixed angle with respect to a supporting surface and to provide electrical contact between the conductive pads 28 and external circuitry. The connector 30 is illustrated as comprising a base 32 for holding the lower edge of the element 10 and a retaining mechanism 34 for holding the upper edge of the element 10. The base 32 comprises a front face 36 having a slot therein defined by a pair of spaced-apart internal sidewalls 38, 40 which extend rearwardly from the front face 36. At a front portion, the sidewalls, particularly the sidewall 38, are shaped and/or spaced to receive the element 10 at an angle with respect to the mating position thereof illustrated in FIG. 1. The wall 40, on the other hand, is provided with a ramp 42 which may be used to advantage in guiding an edge 26 and the surface 24 of the element 10 into the illustrated mating position which is partially defined by a pair of surfaces 44, 46.

The base 32 also comprises a plurality of cavities 48 (only one being illustrated), each receiving a corresponding contact 50 for engaging a respective conductive pad 28. The contact 50 includes a rear tail portion 52 for connection to an external conductive element and a front active portion 54 including a bow portion 56 for yieldable engagement under pressure with the respective conductive pad 28 when the element 10 is in the mating position illustrated in the drawing.

The retaining mechanism 34 comprises a pair of spaced arms 58, each having a recessed edge defined by surfaces 60, 62 which cooperate with the surfaces 44, 46 to form a recess for receiving the element 10. A cover 64 or retaining member is movably mounted on arms 58 and includes a groove 66 for receiving the marginal edges adjacent the end surface 16 of the element 10 and the upper ends of the arms 58. The cover 64 may be secured by an interference fit, a friction fit, or other suitable means of attachment such as a pivot (illustrated in connection with FIG. 2) on one or both arms whereby the cover is pivotally or movably secured on the arms and can be pivoted to one position enabling insertion of the element and pivoted to a second position for holding the pads or contacts of the element engaged with the contacts of the connector. As illustrated in FIG. 1, cover 64 includes an upper portion 67 arranged for abutment against surface 68 of element 10 to restrict rotational movement by forces developed by contact 50 against element 10.

Figure 2:
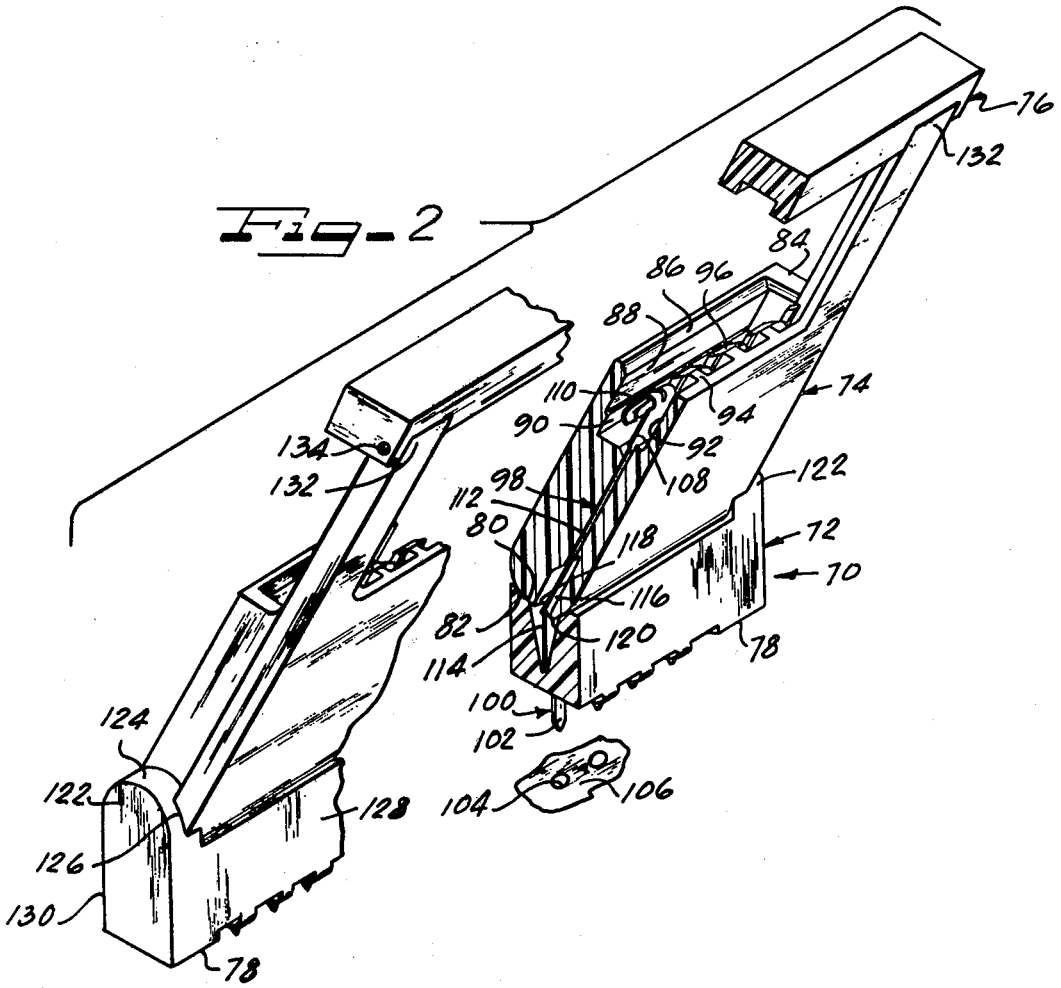
FIG. 2 is a pictorial representation, shown generally from the rear and in partial section, of an electrical connector having a rotatable element holding mechanism according to the invention.

Referring to FIG. 2, an electrical connector for holding the element 10 at any angle between prescribed angular limits is illustrated and generally referenced 70. The connector 70 includes a base 72 and a rotatable member 74 which carries a retaining member or mechanism 76.

The base 72 comprises a mounting surface 78 and an upper concave-shaped surface 80 for receiving a complemental convex surface 82 of the rotatable member 74. As viewed from the top the rotatable member 74 includes a front face 84 from which a pair of sidewalls 86–90 and 92 extend inwardly to define a slot for receiving the element 10.

The sidewall 92 includes spaced projections 94 having respective ramps 96 which extend inwardly and downwardly into the slot. The ramps 96 may also advantageously aid in guiding the element 10 into position much like the ramp 42 in FIG. 1.

As in the previously described connector 30, the connector 70 includes a plurality of cavities 98 (only one being illustrated) each extending through the rotatable member 74 and the base 70 and retaining therein a respective metallic contact 100. Each metallic contact 100 includes a rear tail portion 102 for connection to an external conductive member, as, for example, via a mounting hole 104 of a circuit board 106, a forwardly extending active portion 108 including a bow portion 110 disposed between adjacent ones of the projections 94, an intermediate portion 112 which includes a flat ribbon-like portion 114 disposed in a transversely enlarged portion 118 of the cavity 98 and including an upper bendable portion 116 which is bent by an edge 120 projecting transversely into the enlarged portion of the cavity, as will be hereinafter described.

The base 72 also includes a pair of spaced upwardly projecting members 122 having circular ends 124.

During assembly, the rotatable member 74, with the contacts 100 in place, is aligned with the base 72 such that the cavities 98 extend directly through both parts, the rotatable member 74 is moved downwardly so that the rear tail portions 102 of the contacts 100 extend through the base 72 and the surfaces 80, 82 engage. The rotatable member 74 is then rotated to a desired angular position, as illustrated in FIG. 2, so that the edge 120 projects into the enlarged portion 118 of the cavity 98 and bends the upper portions of the ribbon-like portions of the individual contacts. If rotation is in the opposite direction, the edge transversely opposite the edge 120 would bend the contact.

The rotatable portion is provided with side projections having arcuate surfaces 126 which are complemental to the end surfaces of the projections 122. Angular limits of rotation in this particular embodiment are defined by movement of the arcuate surfaces 126 about the circular surfaces 124 to the points of tangency of the circular surfaces with the flat sides 128, 130 of the base 72.

The retaining member or mechanism 76 is quite similar to that set forth with respect to FIG. 1. It should be noted that in the embodiment illustrated in FIG. 2, the retaining mechanism or cover is secured by means of a groove and recess at 132, and by use of a pivot structure such as by use of a pivot such as pin 134. By the use of pin 134, the cover or retaining member or retaining mechanism 76 is retained or movably secured on the adjacent arms projecting from rotatable member 74. The retaining member is moved or pivoted to a first or open position in which the element 10 can be inserted between the arms to the desired mating position against contact bow portions 110. The cover or retaining member is then pivoted to a second or closed position shown in FIG. 2 for retaining element 10 in the mating position. It will be noted that member 76 is movably secured on the arm means by use of pivot pin 134 or other suitable pivot structure and the pivoting takes place about an axis extending through the upper end of both arms. Thus the member 76 pivots about an axis offset from its center as seen in FIG. 2 so that on clockwise rotation, as seen in that figure, the bottom surface of member 76 pivots from the arms to enable the insertion of a circuit bearing element and on pivoting in the opposite direction, the retaining member closes the recesses in the arms to prevent retraction of the element and secure the same to the arms. The cover 64, shown in FIG. 1, may, of course, be similarly designed for pivotal movement on its arms. Alternatively, the arms and cover may be designed for pivoting the cover about an axis transverse to that shown in FIG. 2 so that the cover pivots at one end from one arm and the other end of the cover swings away from the arm to permit insertion of the element.

Figure 3:
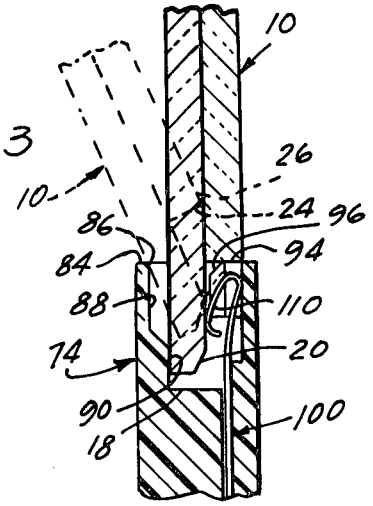
FIG. 3 is a sectional view which illustrates the insertion and seating of a circuit-bearing element in a mating position according to the invention wherein the element experiences low insertion force and high contact pressure.

The element 10 is inserted in the connector 70 in the same manner as in FIG. 1. FIG. 3 illustrates the insertion and seating with reference to the apparatus of FIG. 2; it is, however, equally applicable to the apparatus of FIG. 1. Referring to FIG. 3, the element 10 is illustrated twice, once in solid lines and once in phantom to show the positions of the element as it is initially inserted and then seated in the retaining mechanism. The spacing between the bottom of the slot and the bow portion 110, together with the forward portion of the slot sidewall at 86 and 88 permits initial insertion of the element 10 at an angle with a low insertion force. As the element 10 is rotated (clockwise in FIG. 3) and moved downwardly, the spacing between the bow portion 110 and the sidewall 88 is such that there is little deflection of the bow portion 110 resulting in a low insertion force. As the element 10 is further rotated, however, and the surface 24 is positioned to seat on top of the projections 94, the bow portion 110 of the spring 100 is compressed to establish good electrical contact. In this position, the bottom forward edge of the element 10 is substantially flush with the sidewall portion 90 and the upper part of the element is seated in the recess as described with respect to FIG. 1.

Figure 4:
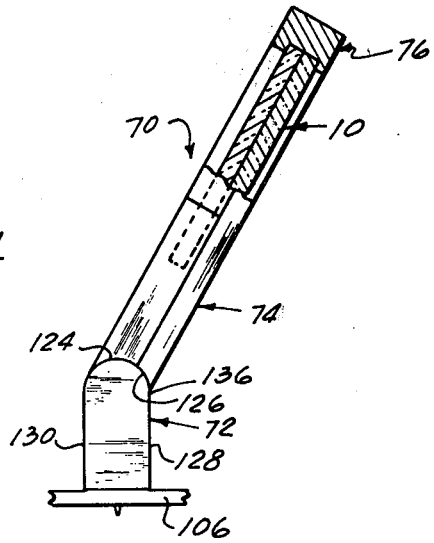
FIG. 4 is a side view of the connector illustrated in FIG. 3.

Referring to FIG. 4, a side view of the connector 70 is shown wherein the substrate is positioned at approximately 60° from the plane of the supporting circuit board 106. In this particular illustration, the point of tangency of the surface 128 and the circular arcuate surface 124 is illustrated at 136. The point 136 therefore defines an arcuate limit for positioning the rotatable member 74. Of course, different limits may be provided by appropriate shaping of the movable part 74 with respect to the base 72.

It will be noted that the applicant has provided an electrical connector 30 or 70 for receiving a flat circuit bearing element 10 having conductive pads on one surface of the element and spaced longitudinally extending edges interconnected by spaced transverse edges. The connector 30 or 70 comprises an insulating housing including a supporting base 32 or 72 respectively and a pair of spaced walls such as 38 and 40 or 86-90 and 92 defining a slot receiving one leading longitudinal edge of the element and a leading portion of the spaced transverse edges and metallic contacts such as 50 or 100 mounted in the housing. The metallic contacts 50 or 100 have a bow portion or cantilever spring portion 56 or 110 respectively projecting from one of side walls into said slot for engagement with a respective contact pad in response to the insertion of the element into the slot. The connector also has guide means which include a pair of spaced arms such as 58 or the corresponding arms on member 74 each secured at one end to the base 32 or 72 and projecting from said base 32 at a selected angle transverse to the front face of the housing or transverse to either a horizontal or vertical plane for receiving and aligning the edges of the element with the slot. The guide means include a ramp surface such as 42 or 94 and 96 for guiding the leading longitudinal edge 26 and surface 24 of the element for engaging each pad with a respective contact cantilever spring or bow portion. A cover 64 or 76 is also provided for engagement with the opposite ends of arms 58 or the arms of member 74 spaced from the base with the cover in overlapping engagement with the other spaced longitudinal edge of the element and the arms in overlapping engagement with the transverse edges to form a window frame at the selected angle in protective support of the element and for enabling facile visual inspection of the element due to the transverse angle and for securing the element in the slot with each pad engaged with a respective spring portion under pressure against the bias of the cantilever spring portion. The cover also serves to unite or join the opposite ends of the projecting arms so that they act as a unitary structure for resisting the weight of the element or other forces.

In summary, with reference to FIG. 1, I have described a preferred embodiment of my invention for a fixed angular position of a circuit-bearing element, and with reference to FIG. 2, I have described another preferred embodiment of my invention wherein the circuit-bearing element may be positioned as various angles with respect to a supporting surface. Although I have described my invention by reference to these specific and illustrative embodiments, many changes and modifications of the invention may become apparent to those skilled in the art without departing from the spirit and scope thereof. I therefore intend to include within the patent warranted hereon all such changes and modifications as may reasonably and properly be included within the scope of my contribution to the art.

I claim:

1. An electrical connector comprising:

an insulating housing including a base, a rotatable member including an elongate front portion and a rear portion rotatably mounted on said base enabling said rotatable member to be rotated in first and second directions about said base, and a contact-receiving cavity extending rearwardly through said base and forwardly through said rotatable member, said cavity including a transversely enlarged portion extending longitudinally between said base and said rotatable member;

at least one metallic contact mounted in said cavity, said metallic contact including a rear tail portion extending rearwardly through said base for connection to an external conductive element, an active portion diposed frontwardly in said rotatable member for engagement with a mating contact, and an intermediate portion including a one-piece flat ribbon-like portion disposed in said enlarged portion in transverse spaced relation to said base and said rotatable member, said ribbon-like portion including an upper portion bendable in said first and second directions as said rotatable member is rotated; and bending means on said rotatable member and arranged to extend into said enlarged portion in a direction opposite to the direction of rotation of said rotatable member during rotation thereof to transversely support said ribbon-like portions as said upper portion is bent.

2. An electrical connector as set forth in claim 1 for mating a circuit-bearing element having a flat portion with conductive pads along an edge thereof, wherein said insulating housing comprises:

a front face and spaced-apart internal sidewalls extending rearwardly therefrom to form an element receiving slot with communicating front and rear portions and a common axis, said front portion having said sidewalls spaced to receive the element upon initial insertion therein at a slight angle from a mating position wherein the element is positioned generally parallel to said axis, and including a ramp on one of said sidewalls for guiding the element into said rear portion whereupon the element can be angularly moved to said mating position in said slot with said contact active portion in engagement with a conductive pad.

3. An electrical connector as set forth in claim 2, wherein said active portion includes a bow portion partially extending away from the other of said sidewalls into said front portion of said slot for yieldable engagement under pressure with one of the conductive pads, said bow portion and said one sidewall being sufficiently spaced apart so that engagement between said bow portion and a pad is at a low pressure during angular insertion of the element, the element angularly moved to said mating position during insertion thereof into said rear portion whereby the pressure of engagement is increased.

4. An electrical connector as set forth in claim 2, and further comprising retaining means for releasably attaching the element in the mating position in said insulating housing.

5. An electrical connector comprising:

an insulating housing including a base, a rotatable member including an elongate front portion and a rear portion rotatably mounted on said base enabling said rotatable member to be rotated in first and second directions about said base, and a contact-receiving cavity extending rearwardly in said base and forwardly in said rotatable member, said cavity including a transversely enlarged portion extending longitudinally between said base and said rotatable member;

at least one metallic contact mounted in said cavity, said metallic contact including:

a rear tail portion extending rearwardly in said base for connection to an external conductive element, an active portion disposed frontwardly in said rotatable member for engagement with a mating contact, and an intermediate portion; and contact bending means on said rotatable member and rotatable into said enlarged portion to bend said contact.

* * * * *